US008866017B2

(12) United States Patent
Tanabe

(10) Patent No.: US 8,866,017 B2
(45) Date of Patent: Oct. 21, 2014

(54) TRANSMISSION CABLE

(75) Inventor: Suguru Tanabe, Ibaraki (JP)

(73) Assignee: Junkosha, Inc., Ibaraki (JP)

( * ) Notice: Subject to any disclaimer, the term of this patent is extended or adjusted under 35 U.S.C. 154(b) by 0 days.

(21) Appl. No.: 13/980,365

(22) PCT Filed: Feb. 13, 2012

(86) PCT No.: PCT/JP2012/053901

§ 371 (c)(1),
(2), (4) Date: Sep. 6, 2013

(87) PCT Pub. No.: WO2012/120993

PCT Pub. Date: Sep. 13, 2012

(65) Prior Publication Data

US 2013/0333917 A1 Dec. 19, 2013

(30) Foreign Application Priority Data

Mar. 4, 2011 (JP) ..... 2011-048265

(51) Int. Cl.

| | |
|---|---|
| ***H01B 7/00*** | (2006.01) |
| ***H01B 7/04*** | (2006.01) |
| *H01B 11/10* | (2006.01) |
| *H01B 11/20* | (2006.01) |

(52) U.S. Cl.

CPC ..... *H01B 7/0009* (2013.01); *H01B 11/1091* (2013.01); *H01B 7/048* (2013.01); *H01B 11/20* (2013.01)

USPC ..... 174/110 R; 174/112; 174/113 R

(58) Field of Classification Search

USPC ..... 174/102 R, 103, 104 R, 105, 106 R, 108, 174/109, 110 R, 115, 116

See application file for complete search history.

(56) References Cited

U.S. PATENT DOCUMENTS

| | | | | | |
|---|---|---|---|---|---|
| 3,286,022 | A | * | 11/1966 | Hvizd, Jr. | 174/105 R |
| 3,482,034 | A | * | 12/1969 | Rhoades et al. | 174/102 R |
| 3,676,576 | A | * | 7/1972 | Dubernet et al. | 174/113 R |
| 3,772,454 | A | * | 11/1973 | Donecker et al. | 174/113 R |
| 4,028,660 | A | * | 6/1977 | Pitts, Jr. | 340/854.9 |
| 4,358,636 | A | * | 11/1982 | Ijff et al. | 174/103 |
| 4,847,448 | A | * | 7/1989 | Sato | 174/103 |
| 4,970,352 | A | * | 11/1990 | Satoh | 174/106 R |
| 5,304,739 | A | * | 4/1994 | Klug et al. | 174/102 R |
| 5,558,794 | A | * | 9/1996 | Jansens | 219/549 |
| 5,739,471 | A | * | 4/1998 | Burisch | 174/102 R |
| 6,300,573 | B1 | | 10/2001 | Horie et al. | |
| 6,376,775 | B1 | * | 4/2002 | Leijon et al. | 174/128.1 |
| 6,982,385 | B2 | * | 1/2006 | Wu | 174/126.1 |

FOREIGN PATENT DOCUMENTS

| | | |
|---|---|---|
| EP | 0962945 | 12/1999 |
| JP | 52-017879 | 2/1977 |
| JP | 63-188816 | 8/1988 |
| JP | 2001-067947 | 3/2001 |
| JP | 2002515630 | 5/2002 |
| JP | 2005-166560 | 6/2005 |
| JP | 2009-277396 | 11/2009 |

* cited by examiner

*Primary Examiner* — William H Mayo, III
(74) *Attorney, Agent, or Firm* — Servilla Whitney LLC

(57) ABSTRACT

A transmission cable that enables an increase in the number of wires or a further reduction in the diameter while having the electrical characteristics equivalent to those of the conventional coaxial cable. The transmission cable includes four first coated conductor units and three second conductor units. One of the first coated conductor units is disposed at the center, and the remaining six units of the first coated conductor units and the second conductor units are disposed around the one first coated conductor unit disposed at the center so as to be adjacent to each other.

7 Claims, 9 Drawing Sheets

TRANSMISSION CABLE

CROSS-REFERENCE TO RELATED APPLICATIONS

This application is the national stage entry of PCT/JP2012/053901, filed on Feb. 13, 2012, which claims priority to Japanese Patent Application Number JP2011-048265, filed on Mar. 4, 2011, both of which are incorporated herein by reference in their entireties.

TECHNICAL FIELD

The present invention relates to a transmission cable, for example, a cable used for transmission of signals, power, and the like in electronic apparatuses, such as a medical apparatus, a communication apparatus, and a computer.

BACKGROUND ART

A multi-core cable that is a cable set having a number of cores is used, for example, as a probe cable of an ultrasonic diagnostic apparatus that is a medical apparatus, a medical cable such as an endoscope cable, or a control cable of a robot for which precise control is required. As these medical apparatuses or control devices become small and light, a reduction in the diameter of the cable for transmission of signals, power, and the like in the apparatuses or devices has been requested. For this reason, development of technology to reduce the diameter without degrading the electrical performance and the like of the cable has been requested.

Meanwhile, with the diversification and increases in the capacity and speed of transmitted information signals, there is also high demand to increase the number of signal lines or the number of power lines while reducing the diameter of the transmission cable as much as possible.

As the transmission cable disclosed in JP-T-2002-515630, a transmission cable using coaxial cables with small outer diameters as multiple cores is used.

The conventional transmission cable described above has excellent electrical characteristics as a coaxial cable. However, as the number of signal lines or the number of power lines is increased, the outer diameter of the cable is also increased. A further study to make the diameter reduction and the increase in the number of wires compatible with each other has not been made. Accordingly, for example, in a medical cable inserted into the blood vessel, it has been difficult to meet the demands of having an ultrafine diameter and information transmission of higher quality.

DISCLOSURE OF INVENTION

The present invention has been made in view of the above problem, and it is an object of the present invention to provide a transmission cable that enables an increase in the number of wires or a further reduction in the diameter while having the electrical characteristics equivalent to those of a conventional coaxial cable.

In order to solve this problem, as a result of earnest and continued research and development, the present inventor found a new structure of the transmission cable that enables an increase in the number of wires or a further reduction in the diameter while having the electrical characteristics equivalent to those of the conventional coaxial cable and thus completed the present invention.

That is, in order to achieve the above-described object, a transmission cable of the present invention includes a total of at least seven units of first coated conductor units, each of which is formed by a first conductor and a dielectric formed on an outer periphery of the first conductor, and second conductor units, each of which has approximately the same diameter as the first coated conductor unit and is disposed adjacent to the dielectric. Either one of the first coated conductor units or one of the second conductor units is disposed at a center, and the remaining six units of the first coated conductor units and the second conductor units are disposed around the one unit disposed at the center so as to be adjacent to each other.

In addition, it is preferable that the transmission cable be an ultrafine cable.

Here, in a first aspect of the present invention, four units of the first coated conductor units and three units of the second conductor units are provided, and one of the first coated conductor units is disposed at the center and the remaining six units of the first coated conductor units and the second conductor units are alternately disposed around the first coated conductor unit disposed at the center.

In addition, in a second aspect of the present invention, three units of the first coated conductor units and four units of the second conductor units are provided, and one of the second coated conductor units is disposed at the center and the remaining six units of the first coated conductor units and the second conductor units are alternately disposed around the second coated conductor unit disposed at the center.

In addition, in a third aspect of the present invention, four units of the first coated conductor units and three units of the second conductor units are provided. One of the second conductor units is disposed at the center. Around the second conductor unit disposed at the center, the remaining two units of the second conductor units among the remaining six units of the first coated conductor units and the second conductor units are disposed so as to be adjacent to the second conductor unit disposed at the center, and the four first coated conductor units are disposed adjacent to each other so as to become two pairs and the two pairs are spaced apart from each other so as to be disposed at target positions with respect to the three second conductor units disposed adjacent to each other.

In addition, it is preferable that the first coated conductor units and the second conductor units be coated with a shielding material that forms an outer coat of the transmission cable.

In addition, it is possible to configure a multi-core transmission cable with multiple cores that includes at least a plurality of the transmission cables described above as units. In this case, the multi-core transmission cable may also include the conventional coaxial cable.

BEST MODE FOR CARRYING OUT THE INVENTION

Embodiments described below are not intended to limit the invention defined in the appended claims, and all combinations of the features described in the embodiments are not necessary for the establishment of the present invention.

The present inventor has reached the invention of a new transmission cable that has the electrical characteristics equivalent to those of the conventional coaxial cable while having the arrangement structure including a new conductor or the like which is different from the conventional coaxial cable having an inner conductor and an outer conductor disposed (formed) on the same axis with a dielectric or the like interposed therebetween. According to this invention, it is possible to further reduce the diameter compared with the conventional coaxial cable and also to increase the number of signal lines and the like compared with the conventional coaxial cable if the same outer diameter is assumed.

Figure 1A:
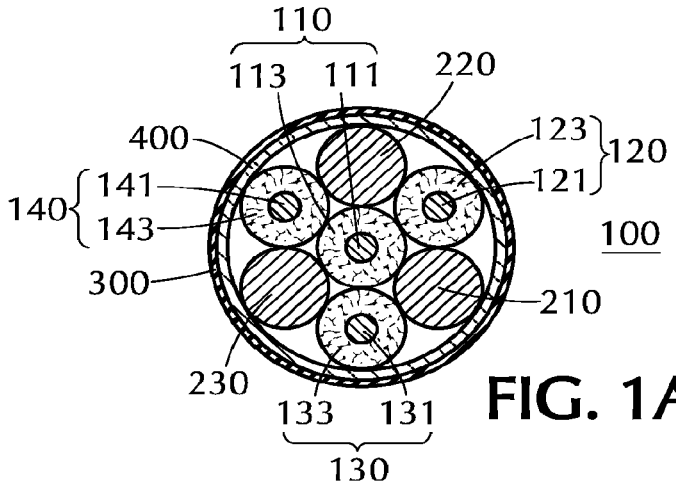
FIG. 1(*a*) is a cross-sectional view of a transmission cable according to a first embodiment of the present invention, FIG. 1(*b*) is a cross-sectional view of a transmission cable according to a second embodiment of the present invention, and FIG. 1(*c*) is a cross-sectional view of a transmission cable according to a third embodiment of the present invention.
Figure 1B:
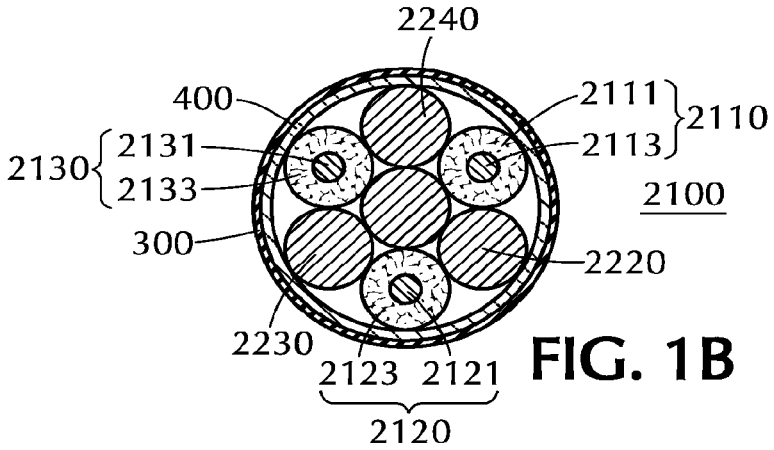
Figure 1C:
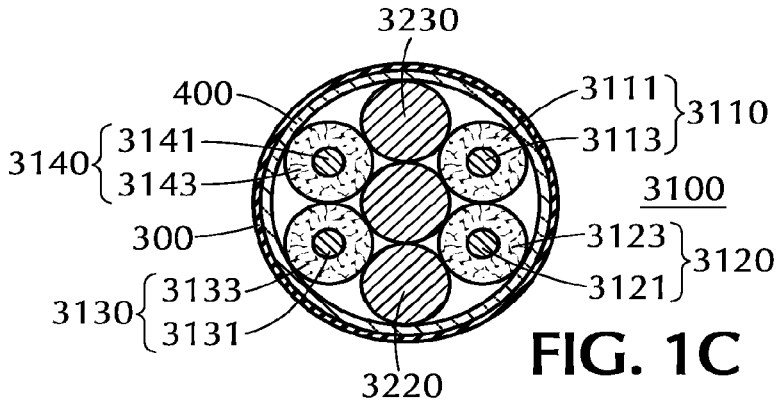

FIG. 1(*a*) is a cross-sectional view of a transmission cable according to a first embodiment of the present invention.

As shown in FIG. 1(*a*), this transmission cable 100 includes a total of seven units of first coated conductor units 110, 120, 130, and 140, which are formed by first conductors 111, 121, 131, and 141 equivalent to the inner conductor in the conventional coaxial cable and dielectrics 113, 123, 133, and 143 formed on the outer periphery of the first conductors 111, 121, 131, and 141, and second conductor units 210, 220, and 230, which have approximately the same diameters as the first coated conductor units 110, 120, 130, and 140 and are disposed adjacent to the dielectrics 113, 123, 133, and 143. These seven units are twisted such that one unit of the first coated conductor unit 110 is disposed at the center and the remaining six units of the first coated conductor units 120, 130, and 140 and the second conductor units 210, 220, and 230 are alternately disposed around the first coated conductor unit 110 so as to be adjacent to each other. In addition, the transmission cable 100 is configured as an ultrafine transmission cable in which the outer periphery of these conductors is coated with a shielding material 300 and the outer periphery of the shielding material 300 is coated with a jacket 400. Here, the first coated conductor units and the second conductor units are configured to have approximately the same outer diameter. By twisting the seven units of the first coated conductor units and the second conductor units as described above, the transmission cable 100 is configured such that the cross-section has a shape of the line almost inscribed on the outer periphery of each of the first coated conductor units and the second conductor units or the shape of the line connecting the centers of the first coated conductor units and the second conductor units is a regular hexagon as shown in FIG. 1(*a*). In this configuration, since the seven units of the first coated conductor units and the second conductor units are twisted, it is possible to maintain the stable positional relationship among the seven twisted units of the first coated conductor units and the second conductor units even if the transmission cable is bent. Accordingly, it is possible to configure a transmission cable capable of suppressing signal degradation.

Here, each of the first conductors 111, 121, 131, and 141 is a simple wire (element wire) of a silver plated copper alloy wire having a diameter of 0.04 mm (AWG 46). On the outer periphery of the first conductors 111, 121, 131, and 141, the dielectrics 113, 123, 133, and 143 formed of perfluorinated ethylene propylene copolymer (hereinafter, referred to as PFA) are coated in a thickness (T) of 0.025 mm so that the characteristic impedance of each signal line (formed by the first coated conductor unit and the second conductor unit adjacent to each other) of the transmission cable becomes 50Ω. On the other hand, each of the second conductor units 210, 220, and 230 is a conductor formed of a silver plated copper alloy wire having a diameter of AWG 40 (which is formed by twisting seven silver plated copper alloy wires having the same thickness of 30 μm). The outer periphery of the seven twisted units of the first coated conductor units and the second conductor units is coated with the shielding material 300 of ALPET (aluminum foil coated with a polyester tape) in a thickness of about 15 μm, and a jacket (with a thickness of 10 μm) formed by winding a polyester tape is coated on the outer periphery of the shielding material 300.

Figure 2B:
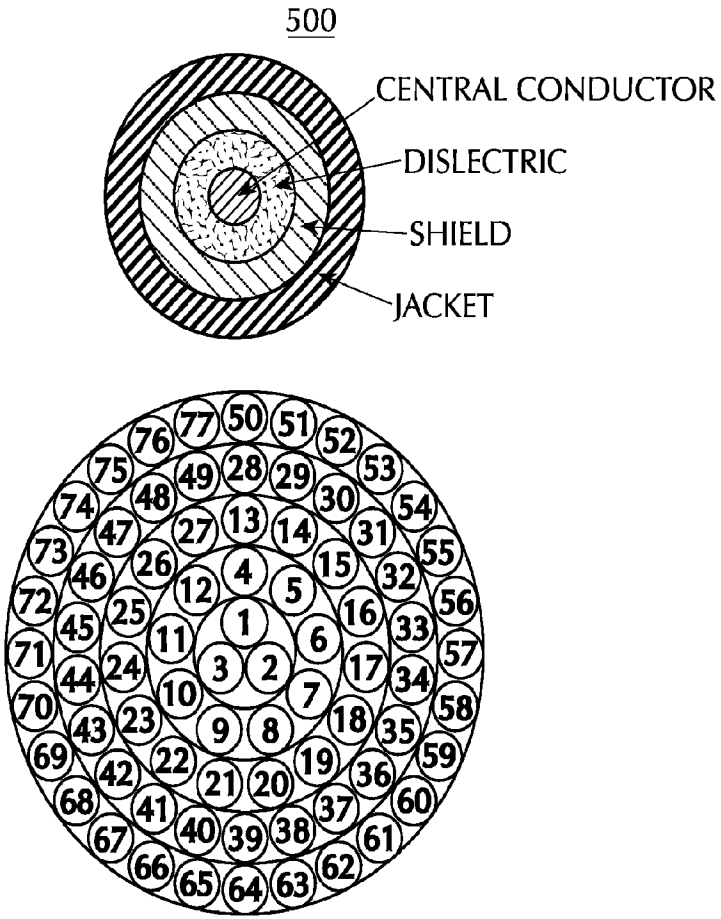
FIG. 2(*a*) is a diagram schematically showing the cross-sectional configuration of a multi-core transmission cable as an example in which the transmission cables according to the first embodiment of the present invention are configured as multiple cores, and FIG. 2(*b*) is a diagram schematically showing the cross-sectional configuration of a multi-core coaxial cable as an example in which conventional coaxial cables are configured as multiple cores.
Figure 2A:
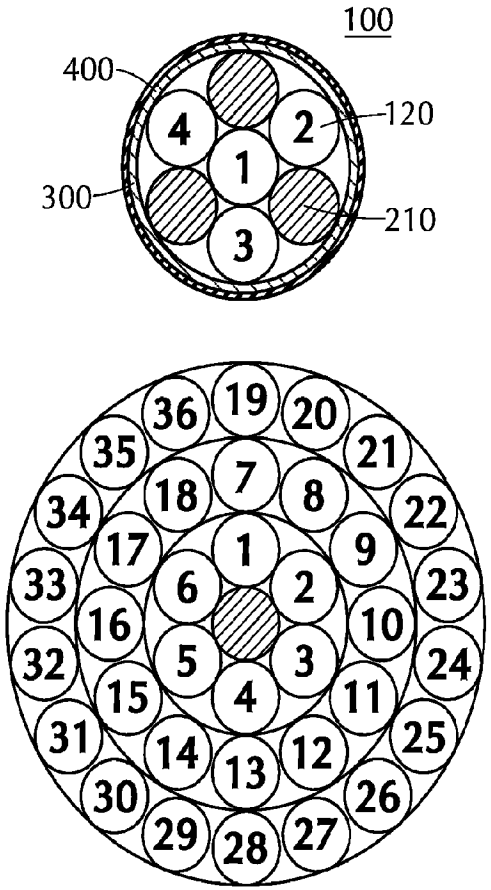

If a multi-core transmission cable is configured using a plurality of transmission cables of the present embodiment configured as described above, it is possible to further reduce the diameter compared with the conventional coaxial cable and also to increase the number of signal lines and the like dramatically compared with the conventional coaxial cable if the same outer diameter is assumed, as shown in FIG. 2(*a*).

FIG. 2(*a*) schematically shows the cross-sectional configuration of a multi-core transmission cable as an example in which the transmission cables according to the first embodiment of the present invention are configured as multiple cores. FIG. 2(*b*) schematically shows the cross-sectional configuration of a multi-core coaxial cable as an example in which the conventional coaxial cables are configured as multiple cores.

In FIG. 2(*a*), the upper diagram shows the transmission cable 100 according to the first embodiment described above, and it is assumed that the characteristic impedance of each signal line (formed by the first coated conductor unit and the second conductor unit adjacent to each other) of the transmission cable is set to 50Ω using a simple wire (element wire) of a silver plated copper alloy wire with an outer diameter of 0.03 mm (AWG 48) as the first conductors 111, 121, 131, and 141, a dielectric formed of PFA is coated in a thickness of about 15 μm on the outer periphery of the first conductor, each of the second conductor units 210, 220, and 230 is formed of a conductor of AWG 44 (twisted wire obtained by twisting seven silver plated copper alloy wires with a thickness of 20 μm), and the entire transmission cable 100 is formed in the outer diameter ϕ of 0.22 mm. When forming a multi-core transmission cable with the outer diameter ϕ of 1.5 mm using the transmission cable 100, it is possible to form a multi-core cable with 144 cores as shown in the lower diagram of FIG. 2(*a*).

On the other hand, in FIG. 2(*b*), the upper diagram shows a coaxial cable 500 in which the conventional silver plated copper alloy wire of AWG 48 is used as a central conductor. The coaxial cable 500 is formed by coating a dielectric formed of PFA around the central conductor and coating an outer conductor and a jacket around the dielectric so that the characteristic impedance becomes 50Ω. Accordingly, the entire coaxial cable 500 is formed in the outer diameter ϕ of 0.15 mm. When forming a multi-core transmission cable with the outer diameter ϕ of 1.5 mm using the coaxial cable 500, a multi-core cable with 77 cores can only be formed.

As described above, by forming the multi-core transmission cable using the transmission cable according to the present embodiment, it is possible to obtain approximately the double wiring density if the same outer diameter is assumed and it is possible to reduce the outer diameter to approximately the half in order to obtain the same wiring density (the number of cores) compared with a case where the multi-core transmission cable is formed by using the transmission cable of the present embodiment and a coaxial cable with the same characteristic impedance as each signal line (formed by the first coated conductor unit and the second conductor unit adjacent to each other) of the transmission cable using a central conductor having the same diameter as the conventional first conductor.

As will be described later, the electrical characteristics (transmission characteristics) substantially equal to or greater than those of the conventional coaxial cable are obtained with the transmission cable according to the present embodiment, and the reason (principle) has been considered.

Figure 3A:
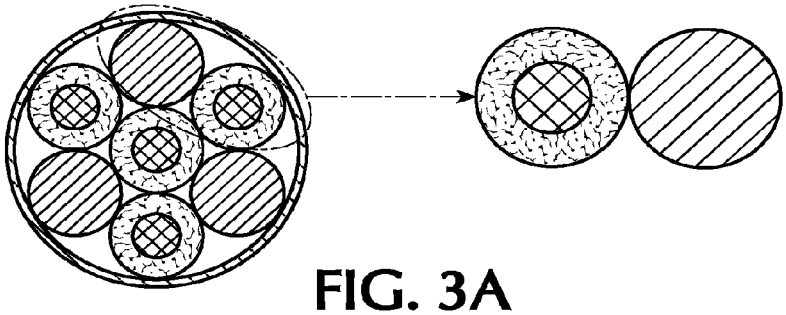
FIG. 3 is a diagram for explaining a transmission image (principle) of the transmission cable according to the first embodiment of the present invention, where FIG. 3(*a*) shows the transmission image (principle), FIG. 3(*b*) shows a change in the electromagnetic field in the case of an ultrafine cable, and FIG. 3(*c*) shows a transmission image (principle) of a conventional coaxial cable.
Figure 3B:
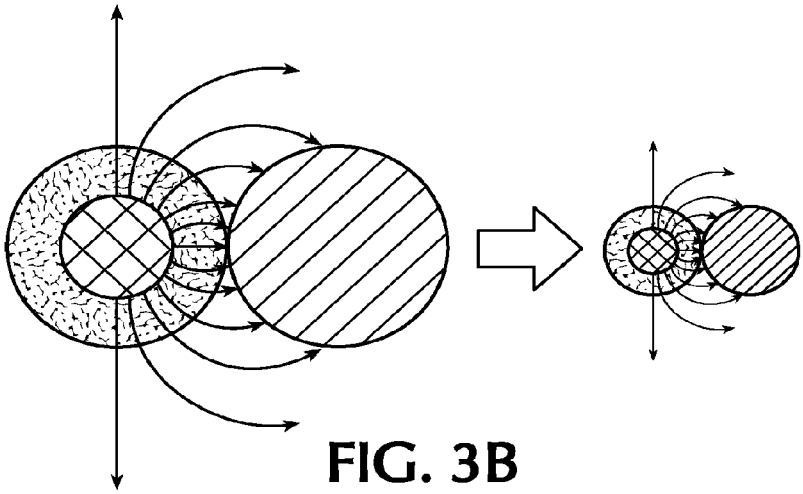
Figure 3C:
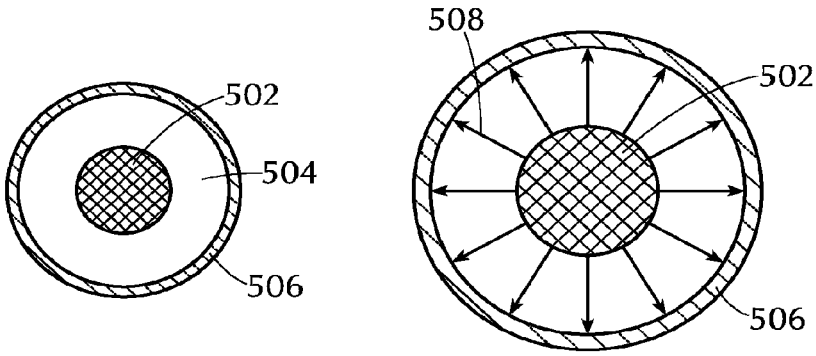

FIG. 3 is a diagram for explaining a transmission image (principle) of the transmission cable according to the first embodiment of the present invention. FIG. 3(*a*) shows the transmission image (principle), FIG. 3(*b*) is a diagram for explaining a change in the electromagnetic field in the case of an ultrafine cable, and FIG. 3(*c*) is a diagram showing a transmission image (principle) of a conventional coaxial cable.

In FIG. 3(*a*), the left diagram shows the transmission cable according to the first embodiment, the structure can be decomposed into the simplest structures.

Here, in FIG. 3(*c*), the upper diagram shows a conventional coaxial-structure cable configured to include a central conductor 502, a dielectric 504, and an outer conductor 506. In this coaxial-structure cable, as shown in the lower diagram of FIG. 3(*c*), it is possible to obtain high transmission quality since the electromagnetic field distribution 508 between the central conductor 502 and the outer conductor 506 is uniform.

On the other hand, in FIG. 3(*b*), in the case of the structure shown in the right diagram of FIG. 3(*a*), the electromagnetic field distribution 108 between the first conductor equivalent to the central conductor and the second conductor (unit) equivalent to the outer conductor may be non-uniform and radiation to the outside occurs easily as shown in the left diagram of FIG. 3(*b*). Therefore, with the simple structure shown in the right diagram of FIG. 3(*a*) described above, the transmission quality is degraded since the transmission loss is large, crosstalk between signal lines is large, and the influence of internal and external noise is easily received. For this reason, there is a possibility that the electrical characteristics equivalent to those of the conventional coaxial cable will no longer be obtained.

The present inventor has devised the cable (wiring) structure according to the first embodiment described above and cable (wiring) structures according to second and third embodiments, which will be described later, as structures that can solve these problems.

That is, as a first feature of the transmission cable according to the embodiment of the present invention, a structure that can substantially neglect the influence on the transmission quality due to the non-uniformity of the electromagnetic field distribution 108 is obtained by increasing the electrical coupling between the first conductor equivalent to the central conductor and the second conductor (unit) equivalent to the outer conductor (by increasing the electromagnetic field strength) by arranging the ultrafine electrical wire at the shortest distance as shown in the left and right diagrams of FIG. 3(*b*).

That is, also in the case of the simple structure shown in the right diagram of FIG. 3(*a*) described above, if the electrical wire becomes thin, the distance between the first conductor equivalent to the central conductor and the second conductor (unit) equivalent to the outer conductor is significantly reduced. Then, since the strength of the electric field is greatly increased, electrical coupling becomes strong. As a result, since losses due to radiations other than the radiation between conductors and the like are reduced, it is understood that the degradation of transmission quality is suppressed.

Figure 4A:
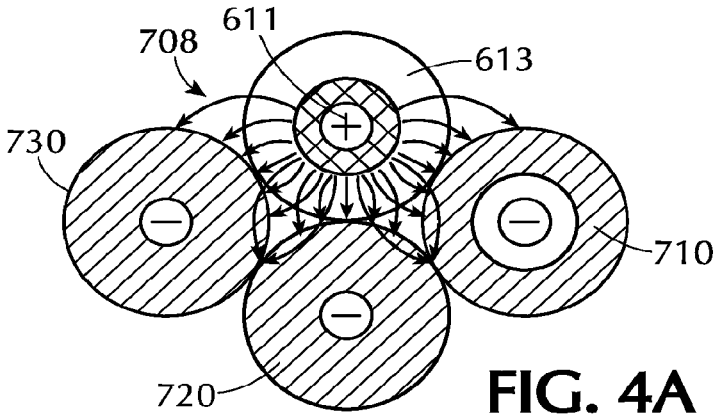
FIG. 4 is a diagram for explaining the transmission principle of the transmission cable according to the first embodiment of the present invention, where FIG. 4(*a*) shows a state of the electromagnetic field between the conductors, FIG. 4(*b*) shows the effect of the shielding material, and FIG. 4(*c*) shows the relationship between the state and the polarity of the electromagnetic field between the conductors.
Figure 4B:
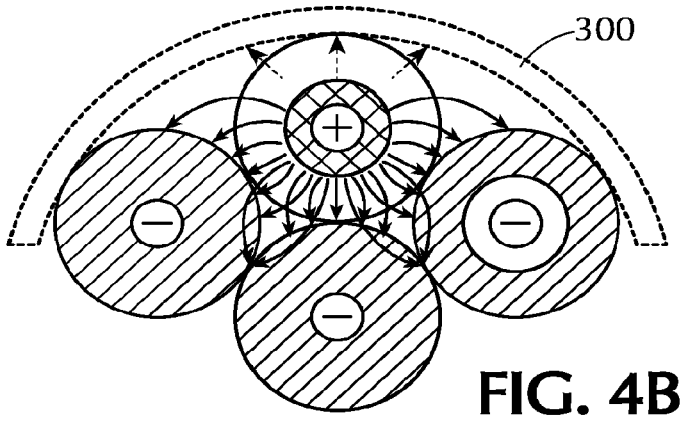
Figure 4C:
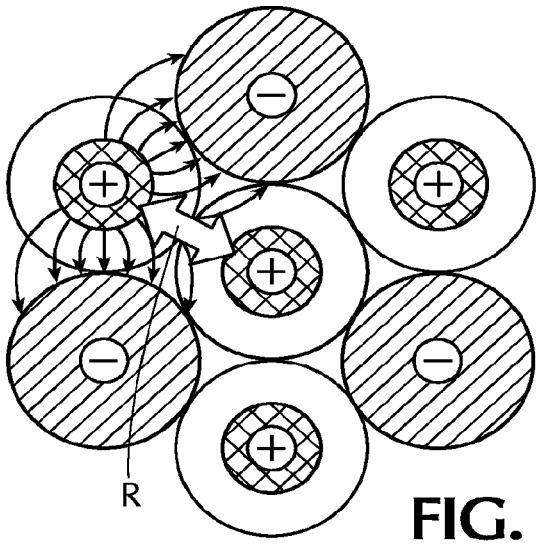

FIG. 4 is a diagram for explaining the transmission principle of the transmission cable according to the embodiment of the present invention. FIG. 4(*a*) shows a state of the electromagnetic field between the conductors, FIG. 4(*b*) shows the effect of the shielding material, and FIG. 4(*c*) shows the relationship between the state and the polarity of the electromagnetic field between the conductors.

In FIG. 4(*a*), (although these are equivalent to portions extracted from the transmission cable of the second embodiment to be described later), three second conductors (units) 710, 720, and 730 are disposed so as to be adjacent to a first conductor 611 with a dielectric 613 interposed therebetween, and the electromagnetic field distribution 708 is formed between the first conductor 611 equivalent to the central conductor and each of the second conductors (units) 710, 720, and 730 equivalent to the outer conductor. Here, also in the structure shown in FIG. 4(*a*), as described above, in the transmission cable according to the embodiment of the present invention, the first conductor 611 and the second conductors (units) 710, 720, and 730 that are ultrafine electric wires are disposed so as to be adjacent to each other with the dielectric 613 interposed therebetween. Accordingly, since the distance between the first conductor 611 equivalent to the central conductor and each of the second conductors (units) 710, 720, and 730 equivalent to the outer conductor is significantly reduced, the strength of the electric field is greatly increased and electrical coupling becomes strong. As a result, since losses due to radiation other than the radiation between conductors and the like are reduced, the degradation of transmission quality is suppressed. In addition, since the first coated conductor unit shown in FIG. 4(*a*) and other first coated conductor units (not shown) are disposed so as to be separated from each other by the second conductors (units) 710, 720, and 730, the distance between the first conductors is increased by setting the diameters of the second conductors (units) 710, 720, and 730 to approximately the same diameter of the first coated conductor unit. As a result, the effect of suppressing the interference between the first conductors is enhanced.

In addition, in the transmission cable of the present invention, the signal line is formed by the first coated conductor unit, which is equivalent to the central conductor and the dielectric provided on the outer periphery, and the second conductors (units), which are adjacent to the first coated conductor unit and are equivalent to the outer conductor. In the configuration of the present invention, each condition (type or outer diameter of the dielectric, outer diameter of the outer conductor, and the like) is set such that the characteristic impedance determined in this signal line is obtained. The characteristic impedance of the signal line of the present invention corresponds to the characteristic impedance of the conventional coaxial cable (However, in the differential configuration according to the third embodiment of the present invention to be described later, a signal line is formed by first coated conductor units as a pair, and each condition (outer diameter of the dielectric and the like) is set such that the characteristic impedance determined in the signal line is obtained).

In addition, for example, in the structure shown in FIG. 4(*a*), in order to further reduce the losses due to external radiations other than the radiation between conductors and the like, it is effective to coat the outer periphery of the cable with the shielding material 300 as shown in FIG. 4(*b*). According to this configuration, since the radiation to the outside is suppressed by the shielding material 300, it is possible to prevent the degradation of transmission quality effectively. As such a shielding material, a metal deposited tape or a conductive tape obtained by depositing metal foil or metal on the tape can be considered.

In addition, as a third feature of the transmission cable according to the embodiment of the present invention, as shown in FIG. 4(*c*), the interference between a plurality of first conductors equivalent to the central conductor is very low even though a plurality of first conductors equivalent to the central conductor in each coaxial cable and a plurality of second conductors (unit) equivalent to the outer conductor in each coaxial cable are disposed adjacent to each other in a non-coaxial manner in one cable. The reason is as follows. As shown by the arrow R in FIG. 4(*c*), the distance between the first conductors (between the center and the central conductor) increases more as they are spaced apart from each other according to an increase in the thickness of both dielectrics than the distance between the first conductor and the second conductor (between the center and the outer conductor) increases. Accordingly, since the strengths of the electric fields are different, the interference is reduced. In addition, in the present invention, the second conductor (unit) has approximately the same diameter as the first coated conductor unit. Accordingly, since conductor resistance is small compared with a case where the diameter of the second conductor (unit) is smaller than the diameter of the first coated conductor unit, it is possible to further increase the potential difference. As a result, the effect of reducing the interference between the first conductors is increased.

Figure 5:
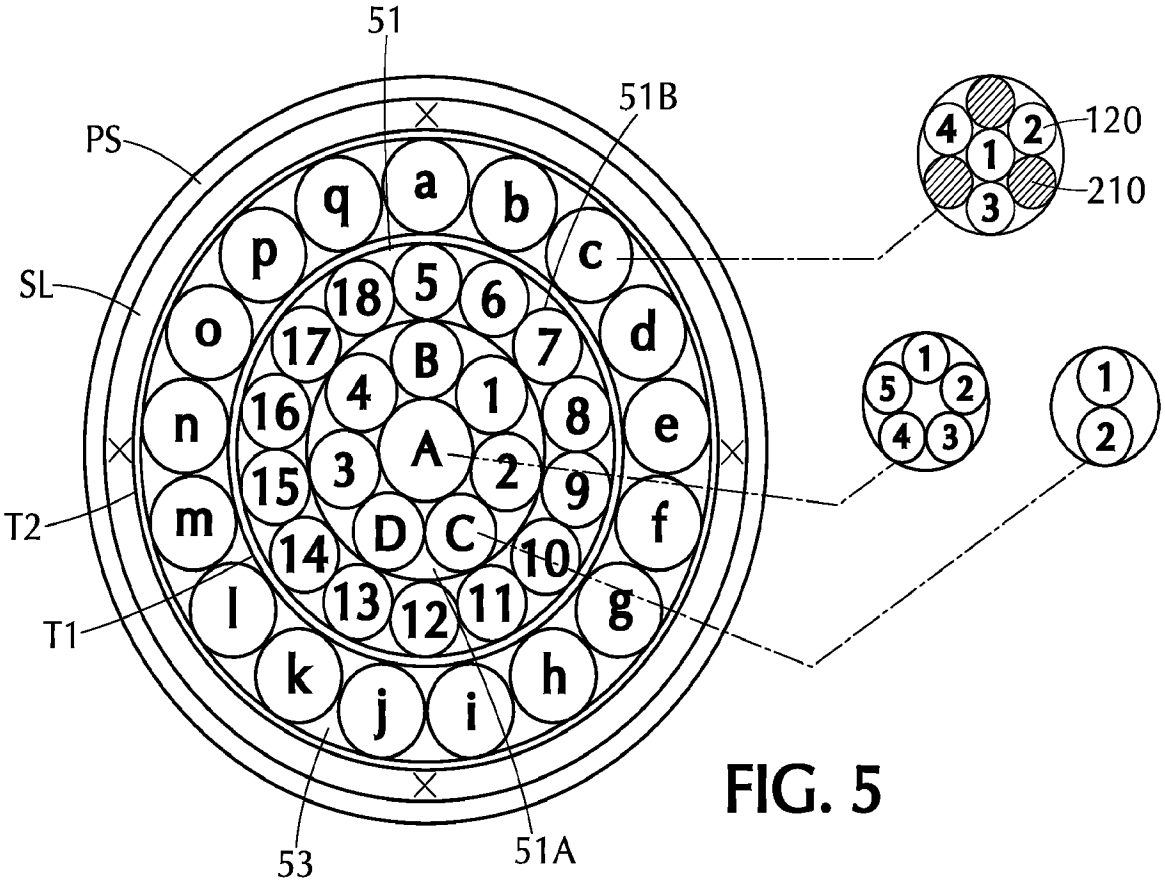
FIG. 5 is a diagram schematically showing the cross-sectional configuration of a multi-core transmission cable as another example in which the transmission cables according to the first embodiment of the present invention are configured as multiple cores.

FIG. 5 is a diagram schematically showing the cross-sectional configuration of a multi-core transmission cable as another example in which the transmission cables according to the first embodiment of the present invention are configured as multiple cores.

As shown in FIG. 5, the multi-core transmission cable of this example is characterized in that it includes a plurality of (17) transmission cables of the first embodiment described above as units and these transmission cables of the first embodiment are configured as a multi-core cable set including the conventional coaxial cable.

That is, as shown in FIG. 5, the multi-core transmission cable of this example has an inner portion 51 and an outer portion 53. The outer portion 53 is formed by arranging the 17 transmission cables of the first embodiment described above on a concentric circle, and the inner portion 51 is formed by arranging a plurality of conventional coaxial cables. More specifically, the inner portion 51 is divided into a central portion 51A and a peripheral portion 51B. In the central portion 51A, units A to D formed by four power lines [AWG 44] and four coaxial cables [AWG 46] 1 to 4 on both the sides are disposed. In the peripheral portion 51B, 14 coaxial cables [AWG 46] 5 to 18 are disposed on the concentric circle.

On the other hand, in the outer portion 53, the above-described 17 transmission cables a to q of the first embodiment are used as signal line units. In each of the transmission cables a to q, each of the first conductors 111, 121, 131, and 141 is formed of a simple wire (element wire) of AWG 48, and each of the second conductor units 210, 220, and 230 is formed of a twisted wire of AWG 40 herein. In addition, an ALPET tape T1 is wound around the peripheral portion 51B, and the outer portion 53 is formed around the ALPET tape T1. In addition, an ALPET tape T2 is also wound around the outer portion 53, a braided shield layer SL is coated on the outer peripheral surface side of the ALPET tape T2, and a PFA sheath PS is further coated on the outer peripheral surface side of the braided shield layer SL. As a result, the entire multi-core transmission cable 700 is formed in the outer diameter ϕ of 1.9 mm. Therefore, since it is possible to configure an ultrafine transmission cable while including these signal lines and the like, it can pass through the space with the outer diameter ϕ of 1.95 mm. For example, the ultrafine transmission cable can be suitably used as a cable for a medical endoscope passing through a blood vessel.

Next, the electrical characteristics (transmission characteristics and the like) of the transmission cable of the present embodiment will be described.

Figure 6:
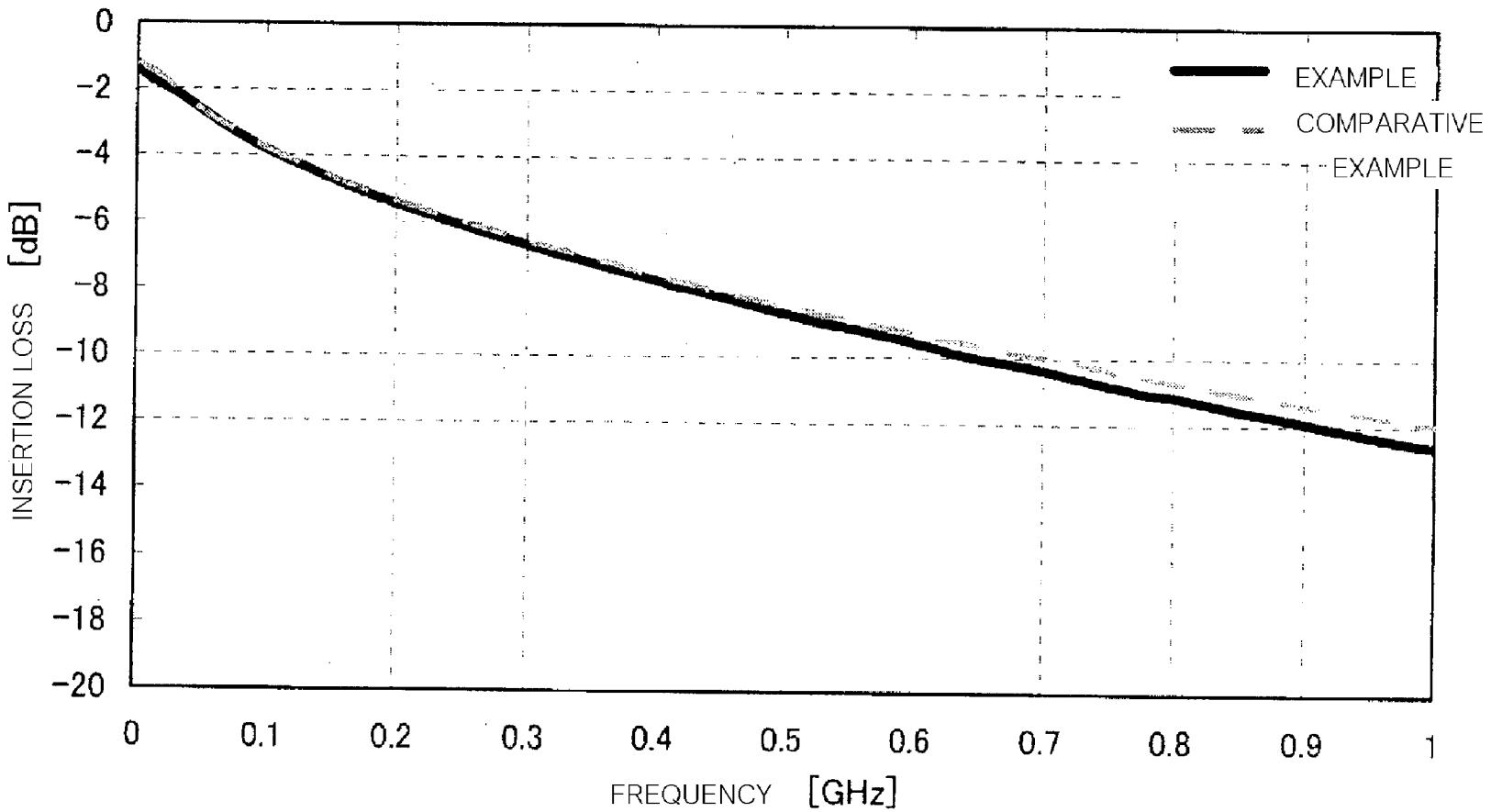
FIG. 6 is a diagram showing the insertion loss among the electrical characteristics of the transmission cable according to the first embodiment of the present invention, and shows the insertion loss together with the same characteristic of the conventional coaxial cable as a comparative example.

FIGS. 6 to 9 are diagrams showing the electrical characteristics of the transmission cable according to the present embodiment together with the same characteristics of the conventional coaxial cable as a comparative example. Here, the first coated conductor units were formed by using a simple wire (element wire) of a silver plated copper alloy wire of AWG 46 as the first conductors 111, 121, 131, and 141 in the transmission cable 100 of the present embodiment and coating a dielectric of PFA around the first conductors such that the characteristic impedance of each signal line (formed by the first coated conductor unit and the second conductor unit adjacent to each other) of the transmission cable became 50Ω, and the second conductor units 210, 220, and 230 were formed of a conductor of AWG 40 (twisted wire obtained by twisting seven silver plated copper alloy wires). In addition, measurement of the coaxial cable of the comparative example was also performed using a configuration in which two coaxial cables (central conductor AWG 46), each of which was formed by using a simple wire of the silver plated copper alloy wire of AWG 46 as the central conductor and coating the dielectric of PFA such that the characteristic impedance became 50Ω, were adjacent to each other in parallel. FIG. 6 is a diagram showing the insertion loss among the above-described electrical characteristics, and shows the insertion loss together with the insertion loss of the conventional coaxial cable as a comparative example. In addition, in FIG. 6, the insertion loss on the vertical axis is expressed by the common logarithm.

That is, in order to examine the insertion loss of the transmission cable of the present embodiment, the present inventor examined the insertion loss [dB] according to the frequency [GHz] when performing transmission using the multi-core transmission cable of one example, which is configured as multiple cores including the cable units with the wiring structure shown in FIG. 1(*a*), and compared it with the insertion loss when performing transmission similarly using the conventional multi-core coaxial cable.

As shown in FIG. 6, in the example and the comparative example, since the insertion losses at each frequency were mostly equal, it was confirmed that there was no difference between both the cables.

Figure 7:
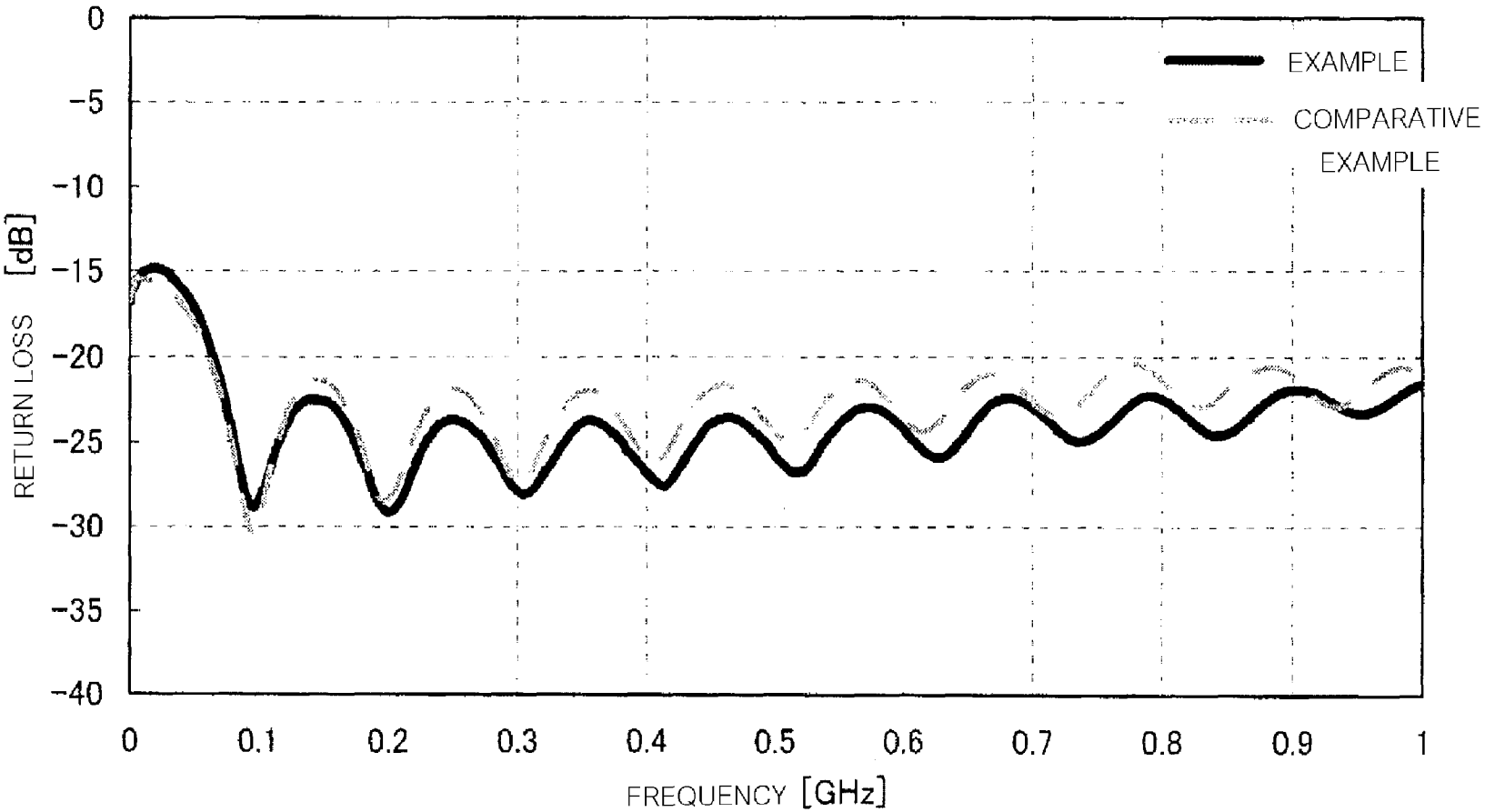
FIG. 7 is a diagram showing the return loss among the electrical characteristics of the transmission cable according to the first embodiment of the present invention, and shows the return loss together with the same characteristic of the conventional coaxial cable as a comparative example.

FIG. 7 is a diagram showing the return loss among the above-described electrical characteristics, and shows the return loss together with the same characteristic of the conventional coaxial cable as a comparative example. In addition, in FIG. 7, the return loss on the vertical axis is expressed by the common logarithm.

Here, in order to examine the return loss of the transmission cable of this example, the return loss [dB] according to the frequency [GHz] when performing transmission using the multi-core transmission cable of this example was examined and compared with the return loss when performing transmission similarly using the conventional multi-core coaxial cable.

As shown in FIG. 7, in the example and the comparative example, since the return losses at each frequency were mostly equal, it was confirmed that there was no difference between both the cables.

Figure 8:
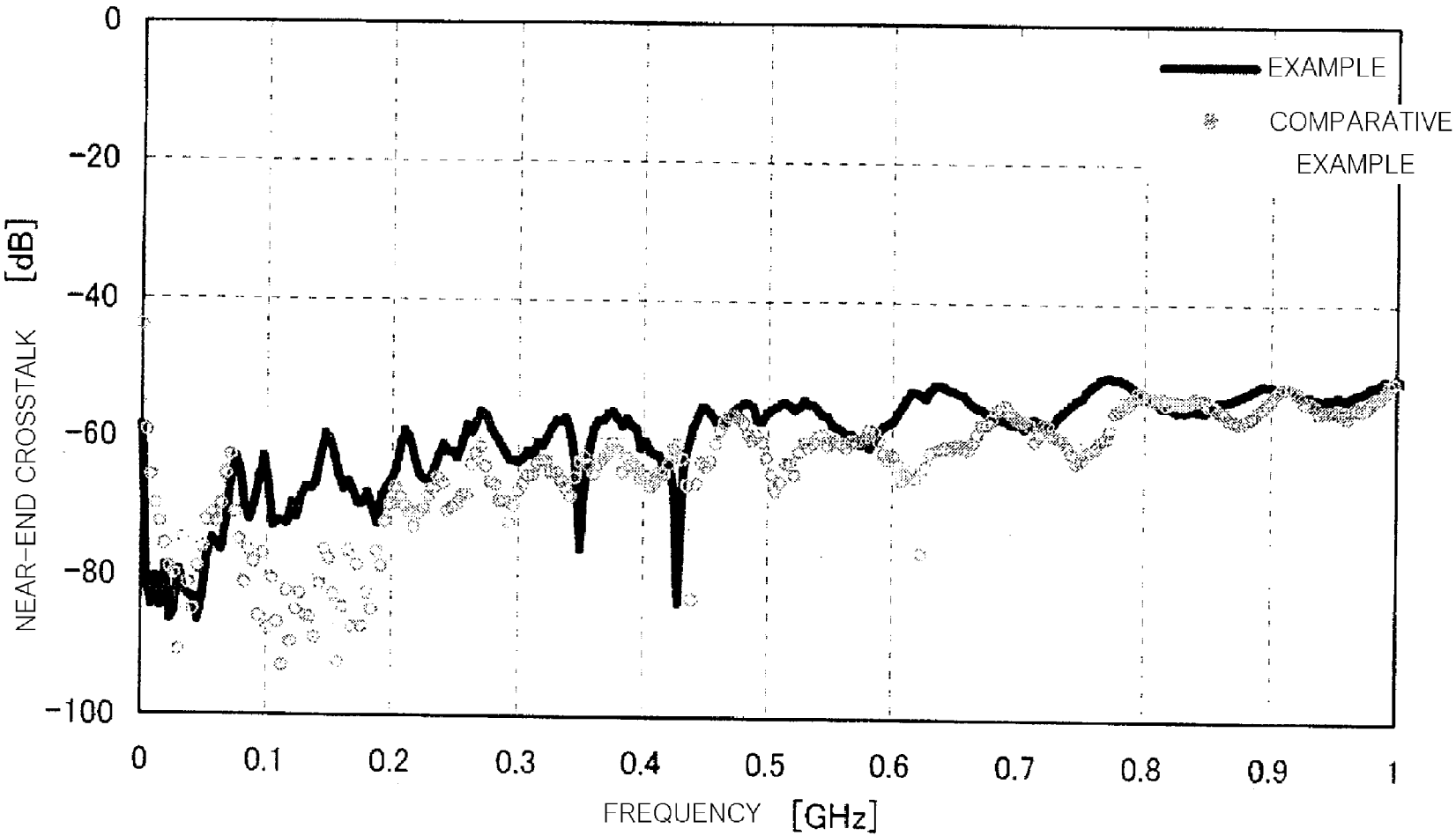
FIG. 8 is a diagram showing the near-end crosstalk characteristic among the electrical characteristics of the transmission cable according to the first embodiment of the present invention, and shows the near-end crosstalk characteristic together with the same characteristic of the conventional coaxial cable as a comparative example.
Figure 9:
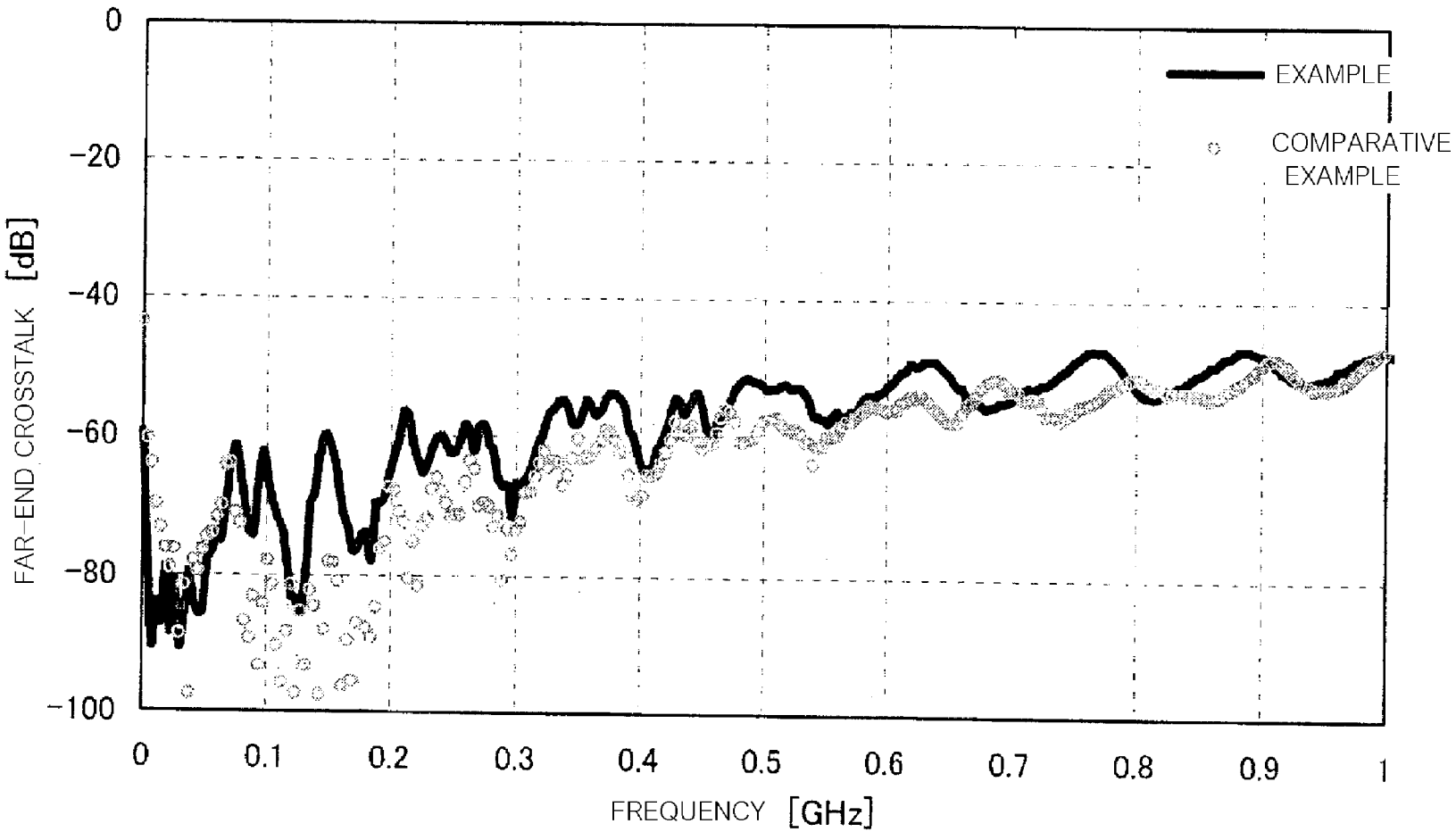
FIG. 9 is a diagram showing the far-end crosstalk characteristic among the electrical characteristics of the transmission cable according to the first embodiment of the present invention, and shows the far-end crosstalk characteristic together with the same characteristic of the conventional coaxial cable as a comparative example.

FIG. 8 is a diagram showing the near-end crosstalk characteristic among the above-described electrical characteristics, and FIG. 9 shows the far-end crosstalk characteristic. Both FIGS. 8 and 9 show the crosstalk characteristic together with the same characteristic of the conventional coaxial cable as a comparative example. For the crosstalk waveform in both diagrams, measurement was performed by comparing the crosstalk between the first conductor and the second conductor, the crosstalk between the first conductor and the third conductor, and the crosstalk between the first conductor and the fourth conductor in the example, and measurement was performed by comparing the crosstalk between the above two coaxial cables in the coaxial cable of the comparative example.

As shown in FIGS. 8 and 9, there was no significant difference between both the crosstalk between near-end conductors (FIG. 8) at each frequency and the crosstalk between far-end conductors (FIG. 9) at each frequency in the example and the crosstalk between both cables in the comparative example. Thus, it was confirmed that the crosstalk was sufficiently suppressed.

As is apparent from FIGS. 6 to 9, according to the transmission cable of the present embodiment, it was found that substantially the same electrical characteristics (transmission characteristic and the like) as in the conventional coaxial cable configured to have the same characteristic impedance were obtained.

Next, a transmission cable according to the second embodiment of the present invention will be described. FIG. 1(*b*) is a cross-sectional view of the transmission cable according to the second embodiment of the present invention.

Both the transmission cable of the first embodiment described above and the transmission cable of the present embodiment are suitable for so-called single end transmission. However, the transmission cable of the first embodiment is a structure with an emphasis on the number of wires in that four first conductors (equivalent to the central conductor) are provided, while the transmission cable of the present embodiment can be said to be a structure with an emphasis on the transmission quality since it is ideal when viewed as a transmission line.

As shown in FIG. 1(*b*), this transmission cable 2100 includes a total of seven units of first coated conductor units 2110, 2120, and 2130, which are formed by first conductors 2111, 2121, and 2131 equivalent to the inner conductor in the conventional coaxial cable and dielectrics 2113, 2123, and 2133 formed on the outer periphery of the first conductors 2111, 2121, and 2131, and second conductor units 2210, 2220, 2230, and 2240, which have approximately the same diameters as the first coated conductor units 2110, 2120, and 2130 and are disposed adjacent to the dielectrics 2113, 2123, 2133, and 2143. One unit of the second conductor unit 2210 is disposed at the center, and the remaining six units of the first coated conductor units 2110, 2120, and 2130 and the second conductor units 2220, 2230, and 2240 are alternately disposed around the second conductor unit 2210 so as to be adjacent to each other. In addition, the transmission cable 2100 is configured as an ultrafine transmission cable in which the outer periphery of these conductors is coated with a shielding material 300 and the outer periphery of the shielding material 300 is coated with a jacket 400. The diameter and wire material of the first conductor, the thickness of the dielectric, the thickness and configuration (twisted wire) of the second conductor unit, the configuration of the shielding material and the jacket, and the like are the same as those in the first embodiment. In addition, also in the present embodiment, each of the first conductors 2111, 2121, and 2131 is a simple wire (element wire) of a silver plated copper alloy wire having a diameter of 0.04 mm (AWG 46). On the outer periphery of the first conductors 2111, 2121, and 2131, the dielectrics 2113, 2123, and 2133 formed of PFA are coated in a thickness of 0.025 mm so that the characteristic impedance of each signal line (formed by the first coated conductor unit and the second conductor unit adjacent to each other) of the transmission cable becomes 50Ω. That is, since the diameter of the first conductor and the value of the characteristic impedance are determined, the thickness of the dielectric is determined according to the material of the dielectric, and the outer diameter of the first coated conductor unit and the outer diameter of the entire transmission cable are thus determined. If a multi-core transmission cable is configured using a plurality of transmission cables of the present embodiment configured as described above, it is possible to further reduce the diameter compared with the conventional coaxial cable and also to increase the number of signal lines and the like dramatically compared with the conventional coaxial cable if the same outer diameter is assumed, as in the first embodiment.

Next, a transmission cable according to the third embodiment of the present invention will be described.

FIG. 1(*c*) is a cross-sectional view of the transmission cable according to the third embodiment of the present invention.

As shown in FIG. 1(*c*), this transmission cable 3100 includes a total of seven units of first coated conductor units 3110, 3120, 3130, and 3140, which are formed by first conductors 3111, 3121, 3131, and 3141 equivalent to the inner conductor in the conventional coaxial cable and dielectrics 3113, 3123, 3133, and 3143 formed on the outer periphery of the first conductors 3111, 3121, 3131, and 3141, and second conductor units 3210, 3220, and 3230, which have approximately the same diameters as the first coated conductor units 3110, 3120, 3130, and 3140 and are disposed adjacent to the dielectrics 3113, 3123, 3133, and 3143. One unit of the second conductor unit 3210 is disposed at the center. Around the second conductor unit 3210, the remaining two units of the second conductor units 3220 and 3230 among the remaining six units of the first coated conductor units and the second conductor units are disposed so as to be adjacent to the second conductor unit 3210 disposed at the center. At the same time, the four first coated conductor units are disposed adjacent to each other for differential transmission so as to become two pairs of a pair 3110 and 3120 and a pair 3130 and 3140, and the two pairs are spaced apart from each other so as to be disposed at target positions with respect to the three second conductor units 3210, 3220, and 3230 disposed adjacent to each other. In addition, the transmission cable 3100 is configured as an ultrafine transmission cable in which the outer periphery of these conductors is coated with a shielding material 300 and the outer periphery of the shielding material 300 is coated with a jacket 400. The diameter and wire material of the first conductor, the thickness of the dielectric, the thickness and configuration (twisted wire) of the second conductor unit, the configuration of the shielding material and the jacket, and the like are the same as those in the first and second embodiments. In addition, since the diameter of the first conductor and the value of the characteristic impedance are determined, the thickness of the dielectric is determined according to the material of the dielectric, and the outer diameter of the first coated conductor unit and the outer diameter of the entire transmission cable are thus determined. This is also the same as in the first and second embodiments. If a multi-core transmission cable is configured using a plurality of transmission cables of the present embodiment configured as described above, it is possible to further reduce the diameter compared with the conventional coaxial cable and also to increase the number of signal lines and the like dramatically compared with the conventional coaxial cable if the same outer diameter is assumed, as in the first and second embodiments.

In the transmission cable of the present embodiment, the arrangement of the first coated conductor units and the second conductor units is for a structure in which noise between the pair of first coated conductor units 3110 and 3120 and another pair of first coated conductor units 3130 and 3140 is easily cut and the electric potential of the ground is easily stabilized. From these points of view, they can be most suitably used for differential transmission. In terms of both the number of wires and the transmission quality, most efficient use is also possible for differential transmission.

As a feature common to the wiring structures of the first to third embodiments described above, a total of seven units of first coated conductor units and second conductor units are provided, either one of the first coated conductor units or one of the second conductor units is disposed at the center, and the remaining six units of the first coated conductor units and the second conductor units are disposed around the one unit disposed at the center so as to be adjacent to each other. According to this arrangement (wiring) structure, if a tangential line common to two adjacent conductor units of the six surrounding conductor units is supposed in each cross-sectional view of FIG. 1, a regular hexagon is formed as a whole. According to such an arrangement (wiring) structure, even when the entire transmission cable is bent, a shift between the respective conductor units is difficult to occur. Therefore, degradation of the transmission performance due to such a shift is eliminated.

In the first to third embodiments, a total of seven units of four first coated conductor units and three second conductor units or three first coated conductor units and four second conductor units are provided. However, a total of nineteen units of ten first coated conductor units and nine second conductor units or nine first coated conductor units and ten second conductor units may be provided. Alternatively, assuming that a total of seven units of four first coated conductor units and three second conductor units or three first coated conductor units and four second conductor units are one unit, it is also possible to consider one cable having a wiring structure of N times the one unit.

In this case, also from the above-described transmission principle of the transmission cable of the present invention, it is preferable to use an ultrafine cable, and the diameter of 0.25 mm can be considered for high frequencies and the diameter of 0.5 mm can be considered for low frequencies.

In addition, as a conductor used in the first coated conductor unit of the transmission cable of the present invention, it is preferable to use a conductor with the outer diameter of AWG 36 to AWG 58. It is more preferable to use a conductor with the outer diameter of AWG 38 to AWG 58, it is still more preferable to use a conductor with the outer diameter of AWG 42 to AWG 58, and it is most preferable to use a conductor with the outer diameter of AWG 46 to AWG 58.

The invention claimed is:

1. A transmission cable comprising:

a total of seven units of first coated conductor units, each of which is formed by a first conductor which corresponds to a central conductor of a coaxial cable, a dielectric formed on an outer periphery of the first conductor, and a plurality of second conductors which corresponds to an outer conductor of a coaxial cable, has an identical diameter as the first coated conductor unit and is disposed adjacent to the dielectric, wherein either one of the first coated conductor units or the second conductor is disposed at a center, and the remaining six first coated conductor units or the second conductor are adjacently disposed to each other, wherein a signal line is formed in one of the first coated conductor units and all second conductors adjacent thereto, and wherein the outer diameter of the dielectric is arranged so that the signal line becomes a predetermined impedance.

2. The transmission cable according to claim 1, wherein the transmission cable is a cable having an outer diameter of 0.5 mm or smaller.

3. The transmission cable according to claim 1 or 2, wherein four of the first coated conductor units and three of the second conductor are provided, and one of the first coated conductor unit is disposed at the center.

4. The transmission cable according to claim 1 or 2, wherein three of the first coated conductor units and four of the second conductors are provided, and one of the second conductors is disposed at the center.

5. The transmission cable according to claim 1, wherein the first coated conductor units and the second conductors are coated with a shielding material to forms an outer coat of the transmission cable.

6. A multi-core transmission cable with multiple cores, comprising at least a plurality of transmission cables according to claim 1 as units.

7. A method of transmitting a signal using a transmission cable comprising:

providing a total of seven units of first coated conductor units, each of which is formed by a first conductor which corresponds to a central conductor of a coaxial cable, a dielectric formed on an outer periphery of the first conductor, and a plurality of second conductors which corresponds to an outer conductor of a coaxial cable, has an identical diameter as the first coated conductor unit and is disposed adjacent to the dielectric, wherein either one of the first coated conductor units or the second conductor is disposed at a center, and the remaining six first coated conductor units or the second conductor are adjacently disposed to each other, forming a signal line is in one of the first coated conductor units and all second conductors adjacent thereto, and arranging an outer diameter of the dielectric so that the signal line becomes a predetermined impedance.

* * * * *